US009850033B2

(12) United States Patent
Buonavoglia

(10) Patent No.: US 9,850,033 B2
(45) Date of Patent: Dec. 26, 2017

(54) COLLAPSIBLE CONTAINER FOR LIQUIDS AND THE LIKE

(71) Applicant: Girolamo Buonavoglia, Stezzano (IT)

(72) Inventor: Girolamo Buonavoglia, Stezzano (IT)

( * ) Notice: Subject to any disclaimer, the term of this patent is extended or adjusted under 35 U.S.C. 154(b) by 0 days.

(21) Appl. No.: 14/368,085

(22) PCT Filed: Dec. 18, 2012

(86) PCT No.: PCT/IB2012/057432

§ 371 (c)(1),
(2) Date: Jun. 23, 2014

(87) PCT Pub. No.: WO2013/093776

PCT Pub. Date: Jun. 27, 2013

(65) Prior Publication Data

US 2014/0348443 A1 Nov. 27, 2014

(30) Foreign Application Priority Data

Dec. 23, 2011 (IT) ..... BG20110047 U

(51) Int. Cl.
*B65D 33/00* (2006.01)
*A45F 3/20* (2006.01)
*B65D 30/28* (2006.01)

(52) U.S. Cl.
CPC ..... *B65D 33/00* (2013.01); *A45F 3/20* (2013.01); *A45F 2003/205* (2013.01); *B65D 31/18* (2013.01)

(58) Field of Classification Search
CPC ..... B65D 33/00; B65D 31/18; B65D 85/52; B65D 85/505; B65D 65/14; B65B 25/026; A45F 3/20; A45F 2003/205
USPC ..... 383/2, 3, 36, 105, 118, 127, 907
See application file for complete search history.

(56) References Cited

U.S. PATENT DOCUMENTS 1,145,093 A * 7/1915 Swift ..... B65D 3/28 206/820
4,284,205 A * 8/1981 Hirata ..... B65D 5/606 229/117.12
4,910,913 A * 3/1990 Streeter ..... 47/72
5,228,234 A * 7/1993 de Klerk et al. ..... 47/41.01
5,388,695 A * 2/1995 Gilbert ..... 206/423
(Continued)

FOREIGN PATENT DOCUMENTS

EP 1 818 276 A1 8/2007
EP 1818276 * 8/2007
(Continued)

*Primary Examiner* — Peter Helvey
(74) *Attorney, Agent, or Firm* — R. Ruschena Patent Agent, LLC

(57) ABSTRACT

A collapsible container (1) for liquids and the like comprising: two deformable membranes (2) placed side by side along an intermediate plane (2*a*) and comprising a plurality of mutually bound edges (3) able to define a housing volume for liquids and an aperture (4) made by two mutually unbound edges and able to form an inlet for liquids, the membranes (2) defining a rest configuration in which they are close to the mutual contact along the intermediate plane (2*a*) and a working configuration, elastically deformed and having an arrow in the direction of mutual removal, by defining a containment volume for liquids and the like, in which the deformable membranes (2) have a shape tapering from said aperture (4) to said opposed end (5).

6 Claims, 1 Drawing Sheet

(56) References Cited

U.S. PATENT DOCUMENTS

| | | | | | |
|---|---|---|---|---|---|
| 5,492,269 | A * | 2/1996 | Sung | B65D 5/3628 | 229/117.06 |
| 5,640,805 | A * | 6/1997 | Weder | 47/72 | |
| 6,129,208 | A * | 10/2000 | Ferguson | 206/423 | |
| 6,438,898 | B1 * | 8/2002 | Weder | 47/72 | |
| 6,523,305 | B2 * | 2/2003 | Weder et al. | 47/72 | |
| 6,574,920 | B1 * | 6/2003 | Weder | 47/72 | |
| 6,584,729 | B2 * | 7/2003 | Weder | 47/72 | |
| 6,647,663 | B2 * | 11/2003 | Weder | 47/72 | |
| 6,691,458 | B2 * | 2/2004 | Weder | 47/72 | |
| 6,701,668 | B2 * | 3/2004 | Weder | 47/72 | |
| 6,702,114 | B1 * | 3/2004 | Weder | 206/423 | |
| 6,705,046 | B2 * | 3/2004 | Weder | 47/76 | |
| 6,775,949 | B2 * | 8/2004 | Weder et al. | 47/72 | |
| 6,786,003 | B2 * | 9/2004 | Gilbert | 47/72 | |
| 6,857,226 | B2 * | 2/2005 | Weder et al. | 47/72 | |
| 6,944,988 | B2 * | 9/2005 | Gilbert | 47/41.01 | |
| 7,093,712 | B2 * | 8/2006 | Weder | 206/423 | |
| 7,152,369 | B2 * | 12/2006 | Weder | 47/72 | |
| D568,528 | S * | 5/2008 | Hood | D26/119 | |
| 8,205,383 | B2 * | 6/2012 | Weder | 47/72 | |
| 8,434,263 | B2 * | 5/2013 | Weder | 47/72 | |
| 8,490,329 | B2 * | 7/2013 | Weder | 47/72 | |
| 8,726,569 | B2 * | 5/2014 | Weder et al. | 47/66.7 | |
| 2007/0151888 | A1 * | 7/2007 | Bossel | B65D 75/008 | 206/495 |

FOREIGN PATENT DOCUMENTS

| | | | | |
|---|---|---|---|---|
| FR | 2 762 200 | A1 | | 10/1998 |
| WO | WO 2007/135494 | | * | 11/2007 |
| WO | WO 2007/135494 | A1 | | 11/2007 |

* cited by examiner

COLLAPSIBLE CONTAINER FOR LIQUIDS AND THE LIKE

RELATED APPLICATIONS

This application is the U.S. National Stage under 35 USC 371 of PCT Application PCT/IB2012/057432, claiming foreign priority on Italian patent application BG2011U000047 filed on Dec. 23, 2011.

BACKGROUND OF THE INVENTION

1. Field of the Invention

The object of the present invention is a collapsible container for liquids of the type pointed out in the preamble of the first claim.

2. Brief Description of the Prior Art

In particular, the invention relates to a glass or other container for liquids, characterized by reduced dimensions, in order to permit a practical and easy transport and which, for simplicity, in the following is substantially indicated with the term "glass".

Collapsible glasses of various shapes are known, such as for example telescopic glasses, mainly used in beaches, picnics, or by boy-scouts.

It is common to all types of such glasses the presence of a rigid support base, with a screw cap at its base, and with a set of mutually sliding rings, such as to define a closed configuration, in which the rings are housed in the support base and the cover is screwed on the base; and an open configuration, in which the cap is removed from the support base and the rings protrude from the base and are mutually engaged by defining said glass.

The known technique mentioned before has some relevant drawbacks.

A first drawback in telescopic glasses consists in that the support base, not being susceptible to compression, determines a relevant encumbrance of said glasses, even in the closed configuration.

Hence, for example, the closed telescopic glasses have in any case a thickness which is usually not lower than 10 mm and makes it unthinkable to house a lot of such glasses, even empty and closed, in a narrow space, such as for example the breast pocket of a jacket.

Furthermore, the use of such glasses usually engages both hands, as they must be opened by unscrewing the cap from the support base.

The telescopic glasses furthermore are not hygienic, as they are not washable into their interstices and cracks, formed among the cylindrical segments.

Another drawback derived from this aspect is represented by the fact that, in some cases, for example typically with mountain tourism, where it could happen that someone has to drink from sources hardly to reach, it is necessary, in order not to expose himself to a danger, to use just one hand in order to catch a handle (branch, protruding rock) so making as a consequence particularly uncomfortable the use of such glasses.

On the other hand, it is also necessary to mention the rather uncomfortable need of an intervention by the user with both hands, also at the time of storing such a glass, due to the fact that said glass does not automatically return to its closed and compressed state.

Another drawback is represented by relatively high producing costs for such telescopic glasses.

SUMMARY OF THE INVENTION

In this situation, the technical task based on the present invention is to design a collapsible container for liquids, in order to substantially obviate to the cited drawbacks.

Within said technical task, an important aim of the invention is to design a collapsible container for liquids, characterized by a reduced encumbrance and which, as a consequence, permits to a user to house a relevant number of them in very narrow spaces.

Another important aim of the invention is to realize a collapsible container for liquids, characterized by reduced production costs.

A further aim of the invention is to obtain a collapsible container for liquids which can be easily used, and in particular which can be utilized with just one hand.

The technical task and the specified aims are reached by a glass according to what is claimed in the annexed claim 1.

Preferred embodiments are pointed out in the dependent claims.

BRIEF DESCRIPTION OF THE DRAWINGS

The properties and advantages of the invention are explained in the following, by a detailed description of a preferred embodiment of the invention with reference to the annexed drawings, in which.

DETAILED DESCRIPTION OF THE PREFERRED EMBODIMENTS

With reference to the cited figures, the collapsible container for liquids according to the invention is indicated as a whole with the numeral 1.

It is substantially made of two deformable membranes 2, placed side by side along an intermediate plane 2*a*.

Said two membranes 2 comprise a plurality of mutually bound edges 3, able to define a housing volume for liquids, and an aperture 4 made of two mutually unbound edges and able to form an inlet for said liquids.

Figure 1:
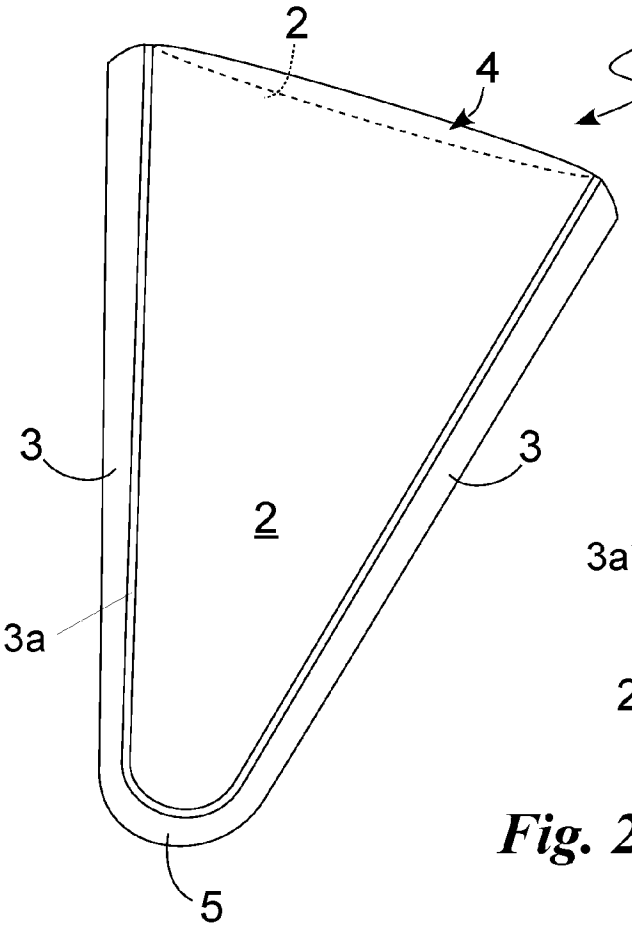
FIG. 1 shows in a side view a collapsible container for liquids according to the invention, in a first configuration.

Said membranes 2 define a rest configuration (FIGS. 1 and 2) in which they are close to the mutual contact along said intermediate plane 2*a* and a working configuration (FIGS. 3 and 4) in which they are deformed, and they form an arrow in the direction of their mutual removal from said intermediate plane 2*a*, by defining a containment volume for liquids and the like.

In particular, the working configuration is obtained by a manual pressure of the bound edges 3 of the deformable membranes 2 along the intermediate plane 2*a*, as will be better pointed out in the following.

In more details, the deformable membranes 2 have an identical profile and a tapering shape from the aperture 4 to the opposed end 5. In particular, the aperture 4 is made of a linear segment, connected by means of two oblique edges 3 with an edge 3 made of a curved top, making the end opposite to the aperture. Suitably, the top edge 3 has a curved shape, so as to connect the two oblique sides. The shape along the intermediate plane 2*a* of the container 1 is hence substantially triangular.

The container 1 has hence preferably neither a bottom nor a support base with respect to an outer surface.

The deformable membranes 2 are preferably made of a polymeric, thermoplastic material and more preferably of polypropylene. They are thermally welded with a thickness profile comprised between 1 and 5 mm and they preferably define an aperture with dimensions comprised between 3 and 10 cm and with a height which is perpendicular with respect to the aperture, with dimensions comprised between 10 cm and 25 cm.

The two membranes 2 also define in a view perpendicular with respect to the intermediate plane 2*a* and parallel to the aperture 4, two convex and preferably slightly convex segments, in order to have a mutual maximum separation, lower than 5 cm and preferably comprised between 1 and 3 mm.

Figure 2:
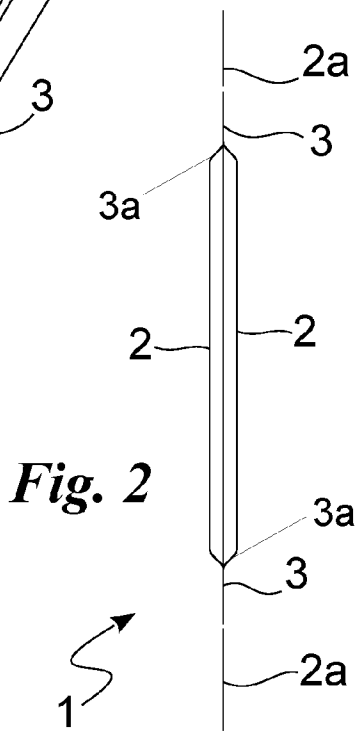
FIG. 2 shows in a top view a collapsible container for liquids according to the invention, in a first configuration.

The convexity is given in particular by a step 3*a* present at the welded edges 3, as shown in FIG. 2. Consequently, in a rest configuration the containers 1 are able to contain a liquid, even if only with little quantities.

At the centre of the container 1 and at the aperture 4 preferably a groove is provided, able to further increase the concavity of the membranes 2 and to form a folding line for the working configuration.

The container 1 comprises, at the aperture 4 and along the edges 3, handles such as in particular holes, in order to insert a collar or a similar support.

Said container is preferably realized by means of moulding, and is preferably made by moulding polymeric membranes, along which portions are realized having the shape of the container 1, and with the convexity previously described.

Said portions are then mutually thermally welded along the edges 3, whereas they are cut at the aperture 4.

The aperture 4 and the top portions at the same are then machined in order to avoid the formation of sharp edges and in order to smooth the same.

The function of a collapsible container 1, previously described in its structural direction, is the following:

First of all, the container 1 is in a rest configuration, i.e. the membranes 2 are mutually placed side by side with a reduced mutual distance.

It is hence defined an inner volume, substantially equal to zero, and it is extended only along the intermediate plane 2*a*. The same is hence pocket-sized or storable or stackable, without occupying a great space.

Figure 3:
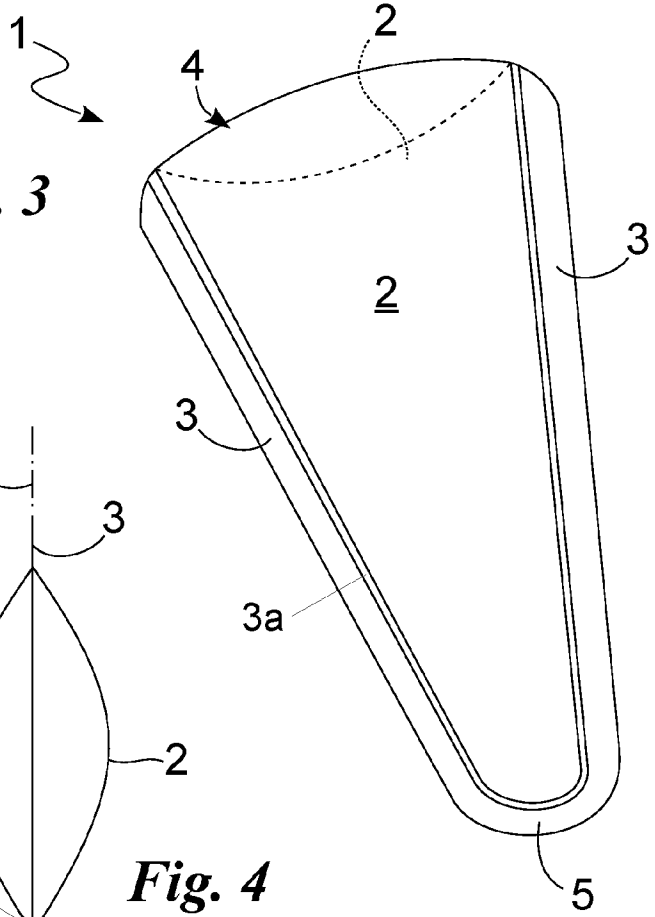
FIG. 3 shows in a side view a collapsible container for liquids according to the invention, in a second configuration.
Figure 4:
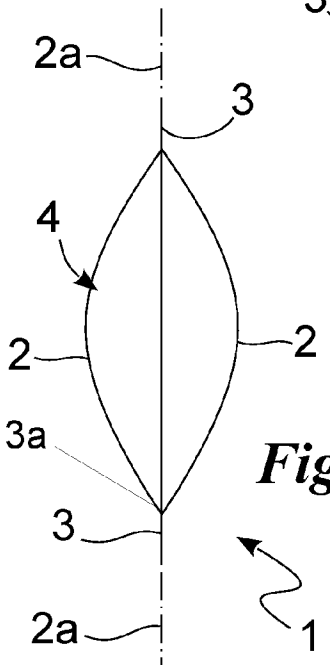
FIG. 4 shows in a top view a collapsible container for liquids according to the invention, in a second configuration.

At the time of use, the user holds with one hand the container 1 at its edges 3, and he tightens his hand, by exerting a deformation movement, substantially parallel to the intermediate plane 2*a* and to the aperture 4, by determining the elastic deformation of the membranes 2 and hence the passage in a working configuration of the container 1 (FIGS. 3 and 4).

The application of such a deformation force, thanks to the convex shape of the profiles 2, gives a reduction of the width of the aperture 4 and, consequently an arrow in the direction of the mutual repelling of the membranes, by defining a containment volume for liquids and the like.

As the operator has ended the use of the container 1, he stops the application of a deforming force, so that the membranes 2 are free to release the stored energy with the elastic deformation, by returning consequently the container 1 in a rest configuration.

The invention permits relevant advantages.

A first relevant advantage is represented by reduced dimensions of the container 1 in a rest configuration.

In fact, the container 1, being free from handles, bases or other protruding parts, has a thickness which is calculated substantially perpendicular to the intermediate plane 2*a*, particularly reduced.

Another advantage is hence due to the fact that the container 1 can be easily inserted in particularly little housings such as, for example, the breast pockets of jackets or trousers. Furthermore, the reduced thickness of the container 1 determines the possibility of folding with extremely reduced forces the container 1 on itself, by further reducing the encumbrances.

Another advantage is therefore due to the fact that the container 1 can be easily transported, and hence it has its ideal use in picnics, beaches, in processions, on mass transport means and the like.

Further applications can be found, for example, in analysis labs or research sites, where it is often necessary to move little quantities of blood, plasma, or the like.

In fact, the possibility of changing the configuration of the container 1 with just one hand gives a high practical use, and hence permits its use also in particularly difficult situations. Such an easy use in particular for opening the container is also due to its particular tapered shape, so permitting to the container 1 to deform itself in a fixed way with the pressure of just one hand. The invention is subjected to variations, all comprised within the inventive concept. All the described and claimed elements can be substituted by equivalent elements and details, materials, shapes and sizes could be made of any kind.

The invention claimed is:

1. A collapsible container (1) for liquids and the like, comprising:

two deformable membranes (2) placed side by side along an intermediate plane (2*a*), said deformable membranes (2) comprising:

a plurality of mutually bound edges (3) able to define a housing volume for liquids and, an aperture (4) made of two mutually unbound edges and able to make an inlet for said liquids, said deformable membranes (2) defining:

a rest configuration in which said two deformable membranes (2) are close to the mutual contact along said intermediate plane (2*a*), and a working configuration in which said two deformable membranes (2) are elastically deformed and form an arrow in a direction of mutual removal, by defining a containment volume for liquids and the like, and wherein said membranes (2) define in a view perpendicular to said intermediate plane (2) and parallel to said aperture (4) and in said rest configuration, two convex segments of which said convexity being facilitated by a step (3*a*) present at said edges (3), and wherein said step (3*a*) has a shape of an arrow, both in a rest and working configuration, defined by a portions of said two membranes (2) adjacent to said welded edges (3), and wherein said collapsible container (1) comprises: a groove at the center of said collapsible container (1), at said aperture (4), able to further increase the concavity of said deformable membranes (2) and to form a folding line for a working configuration;

and wherein said deformable membranes (2) have a shape tapering from said aperture (4) to an opposed end (5), and in which said aperture (4) is opposed to a top edge (3) which defines a bottom of said collapsible container (1), said container (1) having along said intermediate plane (2*a*) a triangular shape with an edge (3) made of a curved top, so as to connect the two oblique sides of said triangular shape;

and wherein said a working configuration is attained when a user holds with one hand said container (1) at its edges (3), and said hand is exerting a deformation movement, substantially parallel to said intermediate plane (2*a*) and to said aperture (4), using elastic deformation of said membranes (2) to achieve said working configuration of said container (1);

and wherein said rest configuration is attained when a user stops exerting a deforming force, so that said membranes (2) are free to release a stored energy of said elastic deformation, by returning consequently said container 1 in a rest configuration;

and wherein said two convex segments have a mutual maximum separation comprised between 1 and 3 mm. to allow the collapsible container to contain a liquid even in a rest configuration and facilitate the moving in opposite directions of said convex segments when both edges (3) are squeezed using only one hand.

2. The collapsible container (1) according to claim 1, wherein said aperture (4) is formed by a linear segment and made of two mutually unbound edges and able to form an inlet for said liquids.

3. The collapsible container (1) according to claim 1, substantially without a bottom or support base to an outer surface.

4. The collapsible container (1) according to claim 1, further comprising, at said aperture (4), handles for inserting a collar or a similar support.

5. The collapsible container (1) according to claim 1, wherein said membranes (2) are made of a polymeric, thermoplastic material.

6. The collapsible container (1) according to claim 1, wherein said membranes (2) are mutually bound by thermal welding.

* * * * *